US011035099B2

(12) United States Patent
Kimura et al.

(10) Patent No.: US 11,035,099 B2
(45) Date of Patent: Jun. 15, 2021

(54) WORK VEHICLE

(71) Applicant: Hitachi Construction Machinery Co., Ltd., Tokyo (JP)

(72) Inventors: Shota Kimura, Tokyo (JP); Tadashi Osaka, Tokyo (JP); Hidekazu Moriki, Tokyo (JP); Kazuo Ishida, Tsuchiura (JP); Noritaka Itou, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 189 days.

(21) Appl. No.: 16/085,402

(22) PCT Filed: Sep. 8, 2017

(86) PCT No.: PCT/JP2017/032569
§ 371 (c)(1),
(2) Date: Sep. 14, 2018

(87) PCT Pub. No.: WO2018/061717
PCT Pub. Date: Apr. 5, 2018

(65) Prior Publication Data

US 2019/0100899 A1 Apr. 4, 2019

(30) Foreign Application Priority Data

Sep. 30, 2016 (JP) ..... JP2016-194662

(51) Int. Cl.
*E02F 9/20* (2006.01)
*E02F 9/22* (2006.01)

(52) U.S. Cl.
CPC ..... *E02F 9/2037* (2013.01); *E02F 9/20* (2013.01); *E02F 9/2033* (2013.01); *E02F 9/22* (2013.01)

(58) Field of Classification Search
CPC ..... E02F 9/2037; E02F 9/20; E02F 9/2033; E02F 9/22
See application file for complete search history.

(56) References Cited

U.S. PATENT DOCUMENTS 9,529,347 B2 * 12/2016 Roach ..... G05B 15/02
2006/0276948 A1 * 12/2006 Toda ..... E02F 9/2246 701/50

(Continued)

FOREIGN PATENT DOCUMENTS

JP 6-58345 A 3/1994
JP 2010-281326 A 12/2010

(Continued)

OTHER PUBLICATIONS

International Search Report (PCT/ISA/210) issued in PCT Application No. PCT/JP2017/032569 dated Dec. 5, 2017 with English translation (four (4) pages).

(Continued)

*Primary Examiner* — Hunter B Lonsberry
*Assistant Examiner* — Elizabeth Yang
(74) *Attorney, Agent, or Firm* — Crowell & Moring LLP

(57) ABSTRACT

A wheel loader includes a working device, a lift cylinder 152 which is a hydraulic actuator that drives the working device, a hydraulic pump 220 that supplies hydraulic oil to the lift cylinder 152, a lift cylinder bottom pressure detector 252 that detects a pressure of the lift cylinder 152, a control valve 221 that controls the amount of hydraulic oil to be supplied from the hydraulic pump 220 to the lift cylinder 152, a vehicle acceleration detector 254 that detects a vehicle acceleration in a longitudinal direction, and a control device 240. The control device 240 determines whether the working device has started excavation, or not, based on the lift cylinder bottom pressure detected by the lift cylinder bottom (Continued)

pressure detector 252 and the vehicle acceleration detected by the vehicle acceleration detector 254.

4 Claims, 12 Drawing Sheets

(56) References Cited

U.S. PATENT DOCUMENTS

| | | | | |
|---|---|---|---|---|
| 2008/0300757 | A1* | 12/2008 | Kanayama | E02F 9/2285 701/50 |
| 2012/0246981 | A1* | 10/2012 | Magaki | E02F 9/2075 37/443 |
| 2012/0310494 | A1* | 12/2012 | Asami | B60W 10/30 701/50 |
| 2013/0004280 | A1* | 1/2013 | Zhang | E02F 9/2296 414/687 |
| 2013/0345936 | A1 | 12/2013 | Callaway et al. | |
| 2014/0129093 | A1* | 5/2014 | Shirao | E02F 3/433 701/50 |
| 2015/0204053 | A1* | 7/2015 | Imaizumi | F02D 29/04 701/50 |
| 2017/0106792 | A1* | 4/2017 | McKee | B66F 9/065 |
| 2018/0230671 | A1* | 8/2018 | Wu | E02F 9/22 |
| 2019/0112788 | A1* | 4/2019 | Enomoto | B60W 30/186 |
| 2019/0285093 | A1* | 9/2019 | Muraoka | E02F 3/435 |
| 2020/0149250 | A1* | 5/2020 | Sugano | E02F 9/20 |

FOREIGN PATENT DOCUMENTS

| | | | |
|---|---|---|---|
| JP | 2014-114778 | A | 6/2014 |
| WO | WO 2005/024208 | A1 | 3/2005 |

OTHER PUBLICATIONS

Japanese-language Written Opinion (PCT/ISA/237) issued in PCT Application No. PCT/JP2017/032569 dated Dec. 5, 2017 (three (3) pages).

* cited by examiner

WORK VEHICLE

TECHNICAL FIELD

The present invention relates to a work vehicle.

BACKGROUND ART

A wheel loader, which is a type of the work vehicle, has a working device for excavation driven by a hydraulic actuator or the like in front of a frame. An operator of the wheel loader advances the vehicle and inserts a leading end of the working device into an excavation target such as crushed stone or earth and sand, then lifts the working device and scoops the excavation target into the working device, to thereby perform excavation.

In the excavation by the wheel loader, in order to prevent slipping of a tire, there is a need to lift the working device at an appropriate timing at the start of excavation. In other words, when the working device has been inserted into the excavation target, a resistance force exerted on the working device from the excavation target acts in a direction in which the hydraulic actuator connecting the working device and the frame contracts. At that time, if the working device is fixed in a vertical direction by the excavation target, the frame is lifted by the hydraulic actuator, a frictional force between a ground and the tire is reduced so that the tire may slip. When the tire slips, not only wear of the tire is accelerated, but also the tire scrapes off a road surface to thereby deteriorate a road surface condition, which leads to a decrease in working efficiency. Therefore, the operator of the wheel loader usually lifts the working device at the time of starting the excavation, and a load is applied to front wheels by a reaction force against the lifted working device, thereby preventing the tires from slipping. However, if the timing at which to lift the working device is early, the working device starts to be lifted before the working device is sufficiently inserted into the excavation target, and the amount of excavation target scooped by the working device decreases. Meanwhile, if the timing at which to lift the working device is delayed, the tire slips as described above. Therefore, the operator of the wheel loader needs to determine the start of excavation at an appropriate timing and perform the lifting operation of the working device.

In the conventional wheel loader, as described above, the operator needs to determine the appropriate excavation start timing. However, it may be difficult for an inexperienced operator to determine the appropriate excavation start timing, for example, when the leading end of the working device cannot be visually observed. To cope with the above case, Patent Literature 1 discloses a technique for determining a state of work in the work vehicle based on a hydraulic pressure of a hydraulic cylinder, an operating state of the working device by the operator, an accelerator opening degree of the work vehicle, and the like.

CITATION LIST

Patent Literature

PATENT LITERATURE 1: WO 2005/024208

SUMMARY OF INVENTION

Technical Problem

In the conventional technique disclosed in Patent Literature 1, the hydraulic pressure of the hydraulic cylinder is compared with a predetermined reference value, and whether the work vehicle is excavating, or not, is determined based on the comparison result. However, the above determination method makes it difficult to quickly and accurately determine the excavation start timing.

Solution to Problem

According to the present invention, there is provided a work vehicle including: a working device; a hydraulic actuator that drives the working device; a hydraulic pump that supplies hydraulic oil to the hydraulic actuator; a hydraulic actuator pressure detector that detects a pressure of the hydraulic actuator; a control valve that controls the amount of hydraulic oil to be supplied from the hydraulic pump to the hydraulic actuator; a vehicle acceleration detector that detects a vehicle acceleration in a longitudinal direction; and a control device that determines whether excavation of the working device has started, or not, based on the pressure of the hydraulic actuator detected by the hydraulic actuator pressure detector and the vehicle acceleration detected by the vehicle acceleration detector.

Advantageous Effects of Invention

According to the present invention, the excavation start timing can be quickly and accurately determined.

DESCRIPTION OF EMBODIMENT

Hereinafter, an embodiment of the present invention will be described with reference to the drawings.

[Configuration of Wheel Loader 100]

Figure 1:
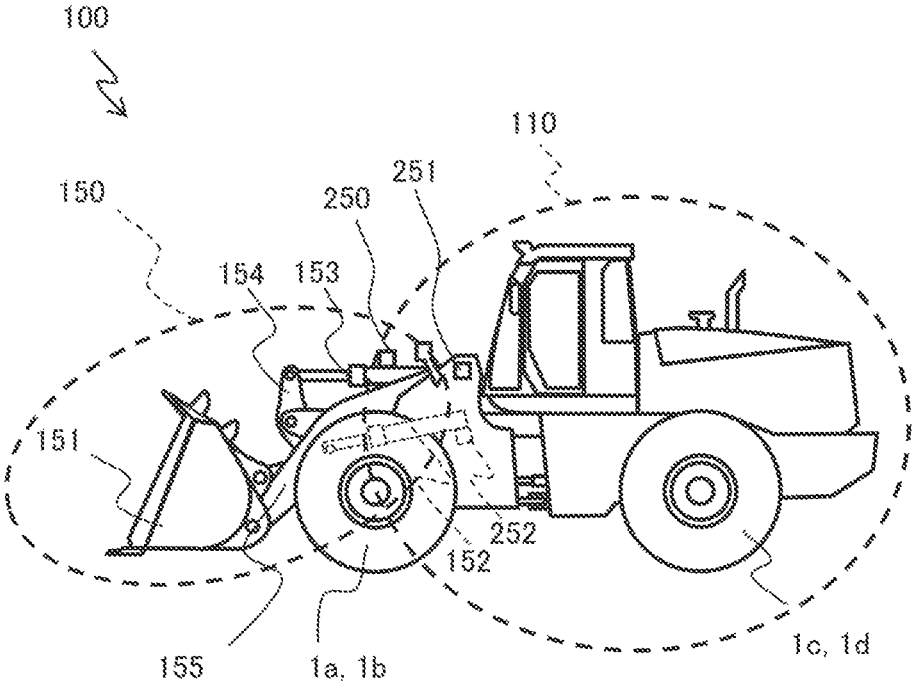
FIG. 1 is a side view of a wheel loader which is a work vehicle according to an embodiment of the present invention.

FIG. 1 is a side view of a wheel loader 100 which is a work vehicle according to an embodiment of the present invention. The wheel loader 100 shown in FIG. 1 includes a frame 110 and an articulated working device 150 that is attached to a front of the frame 110.

The working device 150 is a work device driven by at least one actuator. The working device 150 shown in FIG. 1 includes lift arms 155 and a bucket 151. Lift cylinders 152 and a bucket cylinder 153 are attached between the working device 150 and the frame 110 as hydraulic actuators (hydraulic cylinders) that drive the lift arms 155 and the bucket 151, respectively. Incidentally, the lift arms 155 and the lift cylinders 152 are provided on the left and right sides of the frame 110 one by one, but in FIG. 1, the lift arm 155 and the lift cylinder 152 on the right side of the frame 110 are hidden.

The lift arms 155 rotate (elevate) in a vertical direction as the lift cylinders 152 expand and contract. The bucket 151 rotates (performs dump operation or cloud operation) in association with expansion and contraction of the bucket cylinder 153. Meanwhile, a link mechanism for actuating the bucket 151 of the wheel loader 100 shown in FIG. 1 is of a Z link type (bell crank type) using a bell crank 154.

The lift cylinders 152 are connected to the lift arms 155 and the frame 110. Hereinafter, one side of the lift cylinders 152 connected to the lift arms 155 will be referred to as a rod side and the other side connected to the frame 110 will be referred to as a bottom side. With the supply of hydraulic oil from a hydraulic pump to be described later to the bottom side of the lift cylinders 152, cylinder rods of the lift cylinders 152 are extended to lift the lift arms 155. In addition, with the supply of hydraulic oil from a hydraulic pump to the rod side of the lift cylinders 152, cylinder rods of the lift cylinders 152 are retracted to lower the lift arms 155.

The bucket cylinder 153 is connected to the bell crank 154 and the frame 110. Hereinafter, one side of the bucket cylinder 153 connected to the bell crank 154 will be referred to as the rod side and the other side connected to the frame 110 will be referred to as the bottom side. With the supply of hydraulic oil from the hydraulic pump to the bottom side of the bucket cylinder 153, the cylinder rod of the bucket cylinder 153 is extended, and the bucket 151 rotates so that an opening of the bucket 151 faces upward. In addition, with the supply of hydraulic oil from the hydraulic pump to the rod side of the bucket cylinder 153, the cylinder rod of the bucket cylinder 153 is retracted, and the bucket 151 rotates so that the opening faces downward.

A bucket cylinder stroke detector 250 for detecting a bucket cylinder stroke, that is, the stroke amount of the bucket cylinder 153 is attached to the bucket cylinder 153 in order to determine whether a bottom surface of the bucket 151 is horizontal with respect to the ground, or not. A lift arm angle detector 251 for detecting a lift arm angle, that is, an angle of the lift arm 155 is attached in the vicinity of a connecting portion of the lift arm 155 to the frame 110 in order to determine a height of the lift arm 155.

At the time of starting excavation, an operator sets the bottom surface of the bucket 151 to be horizontal with respect to the ground, and advances the wheel loader 100 toward crushed stone or earth and sand which are the excavation target in an attitude in which the lift arms 155 are lowered to such an extent that the bucket 151 comes in contact with the ground. When a leading end of the working device 150, that is, a leading end of the bucket 151 abuts against the excavation target, the resistance force from the excavation target acts so as to contract the lift cylinders 152, and the pressure of the lift cylinders 152 on the bottom side increases. For that reason, a lift cylinder bottom pressure detector 252 for detecting a lift cylinder bottom pressure, that is, the bottom pressure of the lift cylinders 152 is attached to the lift cylinders 152 in order to detect the resistance force from the excavation target exerted on the working device 150. A resistance force from an excavation target also acts on the bucket cylinder 153, but a magnitude of a pressure change in the bucket cylinder 153 at that time largely changes depending on an angle of the bottom surface of the bucket 151 with respect to the ground. In addition, a pressure change in the lift cylinder 152 on the rod side due to the resistance force from the excavation target is smaller than the pressure change on the bottom side. Therefore, in order to detect the resistance force from the excavation target, it is suitable to detect the lift cylinder bottom pressure.

The frame 110 is provided with four wheels 1*a*, 1*b*, 1*c*, and 1*d*. In FIG. 1, wheels 1*a* and 1*b* on the right side of the frame 110 are hidden. Hereinafter, the wheels 1*a*, 1*b*, 1*c*, and 1*d* may be collectively referred to as "wheels 1". Each wheel 1 is driven by a power transmission device 210 (to be described later) with an engine 201 (to be described later) as a power source. A driving force is transmitted to the ground through each wheel 1 so that the wheel loader 100 travels forward or backward.

Figure 2:
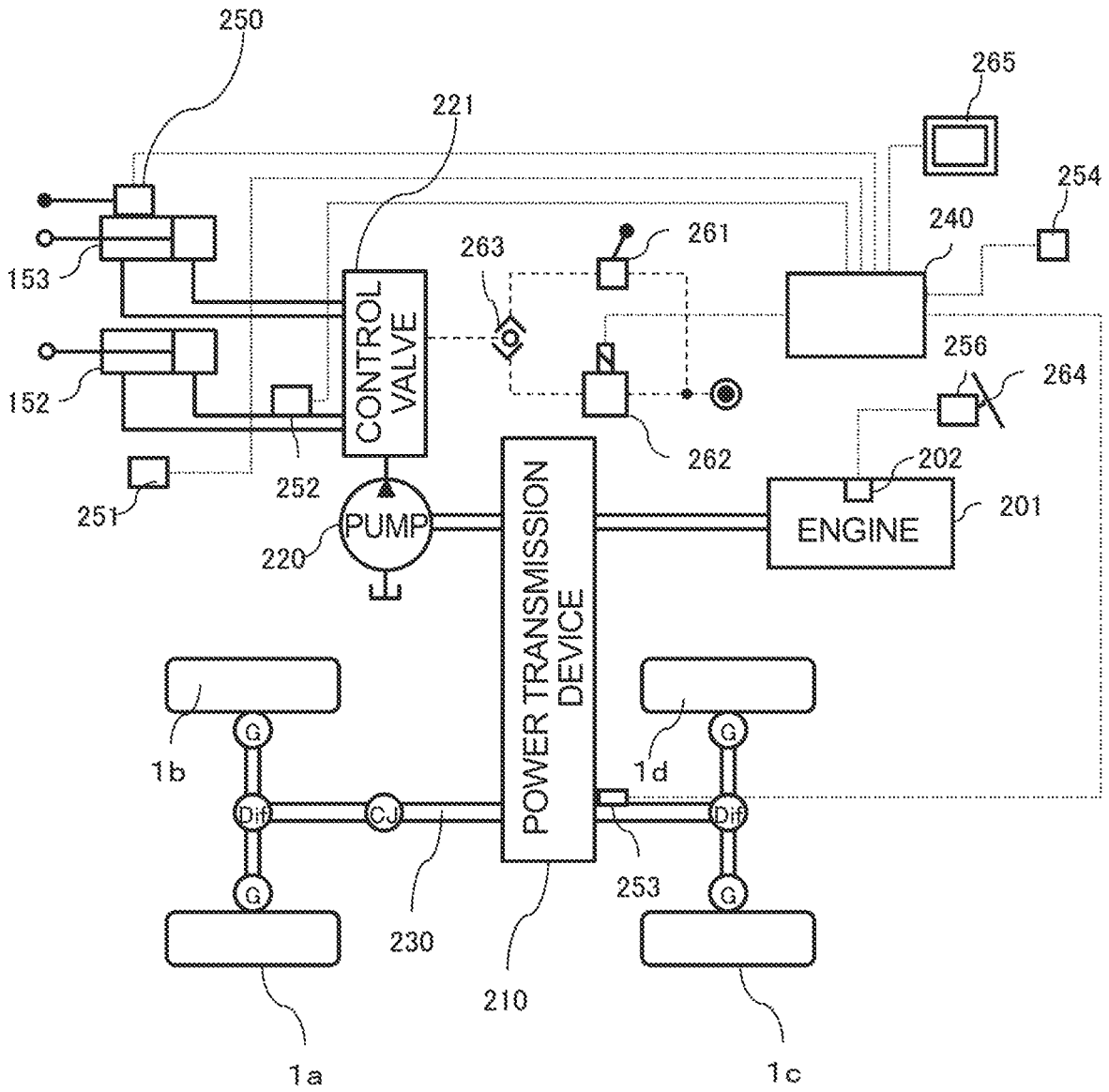
FIG. 2 is a system configuration diagram of a wheel loader according to the embodiment of the present invention.

FIG. 2 is a system configuration diagram of the wheel loader according to the embodiment of the present invention shown in FIG. 1.

The engine 201 supplies a power to the power transmission device 210 and a hydraulic pump 220. The engine 201 has an electronic control governor 202 that controls a fuel injection amount. The electronic control governor 202 controls a fuel injection amount of the engine 201 based on a manipulated variable of an accelerator pedal 264 detected by an accelerator manipulated variable detector 256.

The power transmission device 210 is a power transmission mechanism that transmits a part of the power output from the engine 201 to the wheels 1. For example, a torque converter type, an HST (hydro static transmission) type, an HMT (hydro mechanical transmission) type, a hybrid type, or the like can be adopted as a system of the power transmission device 210. A specific example of the power transmission device 210 will be described later with reference to FIGS. 9 to 12.

The hydraulic pump 220 supplies the hydraulic oil through the control valve 221 to multiple hydraulic actuators associated with the working device 150 including the lift cylinders 152 and the bucket cylinder 153 described above, to thereby appropriately drive each hydraulic actuator. A power source of the hydraulic pump 220 is the engine 201. For that reason, similarly, in each hydraulic actuator having the hydraulic pump 220 as a drive source, the engine 201 serves as a power source as with the wheels 1.

The control valve 221 controls the amount of hydraulic oil to be supplied from the hydraulic pump 220 to the hydraulic actuators (lift cylinders 152, bucket cylinder 153) according to pilot pressures described below. The pilot pressures are output from a working device control lever 261 for controlling the working device 150 and a control valve control section 262. A higher one of the pilot pressures is selected by a high pressure selection valve 263 and acts on the control valve 221. Incidentally, as will be described later, the control valve control section 262 is driven according to an excavation start determination command output from the control device 240.

A vehicle traveling direction detector 253 detects whether a traveling direction of the vehicle, that is, a traveling direction of the wheel loader 100 is forward or backward, based on a rotational direction of a propeller shaft 230, and outputs the detection result to the control device 240. Alternatively, the vehicle traveling direction detector 253 can detect a rotational speed or the like of the propeller shaft 230 and calculate an acceleration and a traveling speed of the wheel loader 100 based on the detection result. For example, the acceleration of the wheel loader 100 can be obtained by differentiating the rotational speed of the propeller shaft 230 detected by the vehicle traveling direction detector 253.

The vehicle acceleration detector 254 detects the vehicle acceleration in the longitudinal direction, that is, the acceleration of the wheel loader 100, and outputs the detected acceleration to the control device 240. When the vehicle acceleration is calculated based on the detection result of the vehicle traveling direction detector 253 as described above, the vehicle acceleration detector 254 may not be provided.

The excavation determination notification section 265 gives a notification to the operator according to an excavation start determination command output from the control device 240. The excavation determination notification section 265 is configured by, for example, a monitor capable of displaying a predetermined screen.

The control device 240 is a computer for executing various types of information processing relating to the operation of the wheel loader 100, and is configured using, for example, a microcomputer. The control device 240 determines whether the working device 150 has started excavation, or not, based on the lift cylinder bottom pressure detected by the lift cylinder bottom pressure detector 252 and the acceleration of the wheel loader 100 in the longitudinal direction detected by the vehicle acceleration detector 254. When the control device 240 has determined that excavation has started, the control device 240 outputs the excavation start determination command. Details of a control process to be performed by the control device 240 will be described later.

Figure 8:
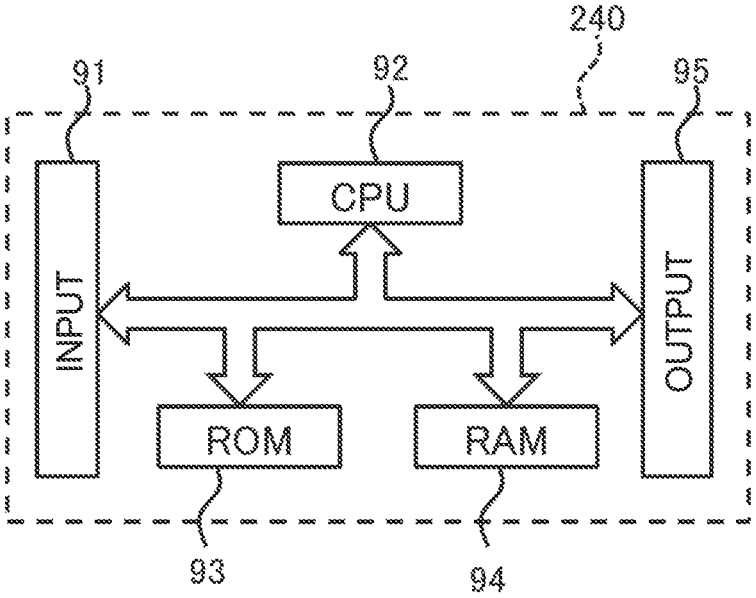
FIG. 8 is a diagram showing a hardware configuration of the control device.

FIG. 8 is a diagram showing a hardware configuration of the control device 240. The control device 240 includes an input section 91, a central processing unit (CPU) 92 which is a processor, a read only memory (ROM) 93 and a random access memory (RAM) 94 which are storage devices, and an output section 95.

The input section 91 receives information and signals output from the lift cylinder bottom pressure detector 252, the vehicle traveling direction detector 253, the vehicle acceleration detector 254, the lift arm angle detector 251, the bucket cylinder stroke detector 250, and the like described above, and outputs the received information and signals to the CPU 92. At that time, the input section 91 performs A/D conversion as occasion demands. The ROM 93 is a recording medium in which programs and the like are stored. The CPU 92 performs predetermined arithmetic processing on the information and signals taken from the input section 91, the ROM 93, and the RAM 94 according to the programs stored in the ROM 93. The output section 95 creates a signal for output according to the calculation result of the CPU 92, and outputs the created signal to the control valve control section 262 and the excavation determination notification section 265. Incidentally, although the control device 240 of FIG. 8 includes the ROM 93 and the RAM 94 which are semiconductor memories as storage devices, the control device 240 may include a magnetic storage device such as a hard disk drive instead of those semiconductor memories and store the programs or the like in the magnetic storage device.

[Control Process of Control Device 240]

Figure 3:
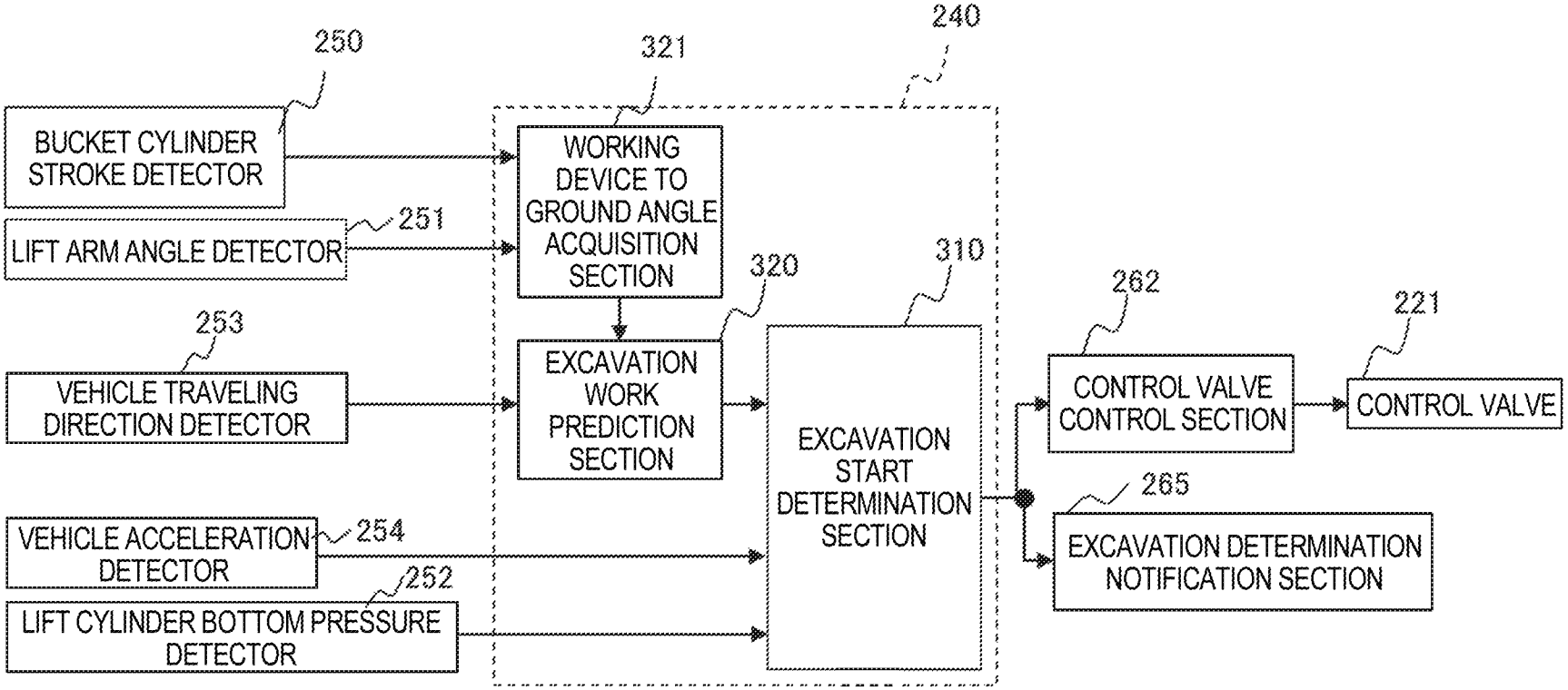
FIG. 3 is a control block diagram of a control device.

Next, details of the control process to be executed by the control device 240 will be described. FIG. 3 is a control block diagram of the control device 240. As shown in FIG. 3, the control device 240 includes a working device to ground angle acquisition section 321, an excavation work prediction section 320, and an excavation start determination section 310 as functions of the control process.

The working device to ground angle acquisition section 321 receives the bucket cylinder stroke detected by the bucket cylinder stroke detector 250 and the lift arm angle detected by the lift arm angle detector 251 as information for calculating the angle of the working device 150 to the ground. The work machine to ground angle acquisition section 321 calculates the working device to ground angle based on those pieces of input information, to thereby acquire the angle of the working device 150 to the ground and output the acquired angle to the excavation work prediction section 320. For example, the working device to ground angle acquisition section 321 may calculate the working device to ground angle corresponding to the input bucket cylinder stroke and lift arm angle geometrically with the use of a mathematical formula based on dimensional parameters of the lift arm 155, the bucket 151, the bell crank 154, and so on configuring the working device 150. Alternatively, the working device to ground angle acquisition section 321 may tabulate a relationship between the stroke amount of the bucket cylinder 153 as well as the angle of the lift arms 155 and the working device to ground angle and store a resultant table in the control device 240 in advance, and obtain the working device to ground angle corresponding to the input bucket cylinder stroke and lift arm angle with the use of the table. Alternatively, the working device to ground angle acquisition section 321 may directly detect the angle of the working device 150 to the ground with the use of a ground angle sensor or the like without using the bucket cylinder stroke detected by the bucket cylinder stroke detector 250 or the lift arm angle detected by the lift arm angle detector 251, to thereby acquire the working device to ground angle.

The excavation work prediction section 320 predicts whether the working device 150 is to perform excavation from now, or not, based on the working device to ground angle acquired by the working device to ground angle acquisition section 321 and the vehicle traveling direction detected by the vehicle traveling direction detector 253. More specifically, when the vehicle traveling direction is forward and the working device to ground angle falls within a predetermined range, the excavation work prediction section 320 determines that the wheel loader 100 is in an excavation start attitude and predicts that the working device 150 will perform excavation. In this situation, the excavation work prediction section 320 outputs an excavation work prediction command to the excavation start determination section 310. Meanwhile, if at least one of those conditions is not satisfied, the excavation work prediction section 320 predicts that the working device 150 will not perform excavation and does not output the excavation work prediction command. Details of the processing of the excavation work prediction section 320 will be described later.

The excavation start determination section 310 receives the excavation work prediction command from the excavation work prediction section 320, the lift cylinder bottom pressure detected by the lift cylinder bottom pressure detector 252, and the vehicle acceleration detected by the vehicle acceleration detector 254 as the information for determining a timing of the appropriate lifting operation of the working device 150. The excavation start determination section 310 determines that the working device 150 has started excavation based on the lift cylinder bottom pressure and the vehicle acceleration when the excavation work prediction command is output from the excavation work prediction section 320. More specifically, when the excavation work prediction command is output and an increasing speed of the lift cylinder bottom pressure is equal to or more than a predetermined threshold value and the vehicle acceleration is equal to or less than the predetermined threshold value, the excavation start determination section 310 detects that a leading end of the bucket 151 has abutted against the excavation target and determines that the working device 150 has started excavation. At that time, the excavation start determination section 310 outputs the excavation start determination command to the control valve control section 262 and the excavation determination notification section 265. Meanwhile, when the excavation work prediction command is not output or when at least one of the increasing speed of the lift cylinder bottom pressure and the vehicle acceleration does not satisfy the above-described conditions, the excavation start determination section 310 determines that the working device 150 has not started excavation and does not output the excavation start determination command. The details of the processing of the excavation start determination section 310 will be described later.

The control valve control section 262 performs a control for lifting the working device 150 at the appropriate timing on the control valve 221 in response to the excavation start determination command output from the excavation start determination section 310. Specifically, when the excavation start determination command is output from the excavation start determination section 310, the control valve control section 262 outputs a predetermined pilot pressure to the control valve 221 and controls the control valve 221 so that the supply of hydraulic oil to the bottom side of the lift cylinder 152 starts. Whereas, when the excavation start determination command is not input, the control valve control section 262 does not supply hydraulic oil to the bottom side of the lift cylinder 152 without outputting the pilot pressure. As a result, since hydraulic oil is supplied from the hydraulic pump 220 to the bottom side of the lift cylinder 152 at an appropriate timing determined by the excavation start determination section 310, and the working device 150 can be lifted without delay, the wheels 1 can be prevented from slipping. When the excavation start determination command is output, the control valve control section 262 may control the control valve 221 so as to supply a maximum amount of hydraulic oil that can be supplied by the hydraulic pump 220 to the bottom side of the lift cylinder 152. Alternatively, the control valve control section 262 may control the control valve 221 so as to have a predetermined supply amount that is less than the maximum amount.

The excavation determination notification section 265 gives a notification to the effect that the operator is urged to lift the working device 150 at an appropriate timing in response to the excavation start determination command output from the excavation start determination section 310. More specifically, when the excavation start determination command is output from the control device 240, the excavation determination notification section 265 displays the determination that the excavation has started on a monitor for the operator. Meanwhile, when the excavation start determination command is not output from the control device 240, the excavation determination notification section 265 does not perform display on the monitor. In this manner, the excavation determination notification section 265 notifies the operator of appropriate excavation start timing, as a result of which the operator can know that the operation of lifting the working device 150 has been performed at an appropriate timing through the control of the control valve control section 262. Further, when the working device 150 is not automatically lifted according to the excavation start timing, for example, when the wheel loader 100 is not provided with the control valve control section 262, the operator can perform a lifting work of the working device 150 without any delay according to notification of the excavation start timing by the excavation determination notification section 265. As a result, the wheels 1 can be prevented from slipping. Incidentally, in addition to the monitor display as described above or in place of the monitor display, the excavation determination notification section 265 may give a notification to the operator by other methods. For example, the excavation determination notification section 265 notifies the operator of the determination that the excavation has started with a change in illuminance of an illumination device in a cabin not shown, occurrence of a sound, or vibration of the working device control lever 261.

[Control Process of Excavation Work Prediction Section 320]

Figure 6:
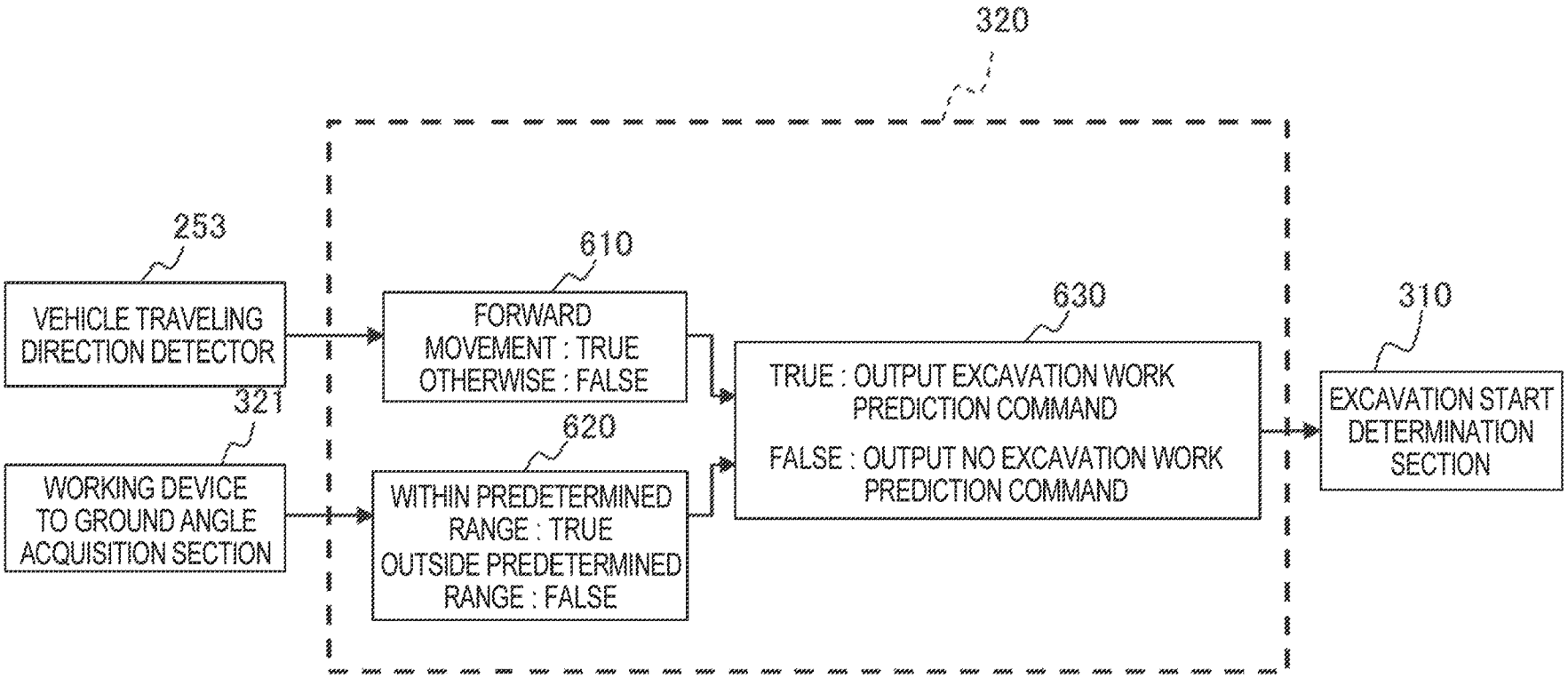
FIG. 6 is a control block diagram of an excavation operation prediction section.

Next, the details of the control process to be executed by the excavation work prediction section 320 will be described. FIG. 6 is a control block diagram of the excavation work prediction section 320. As shown in FIG. 6, the excavation work prediction section 320 includes a vehicle traveling direction determination section 610, a working device to ground angle determination section 620, and an excavation work prediction command section 630 as functions of the control process.

The vehicle traveling direction determination section 610 receives the vehicle traveling direction detected by the vehicle traveling direction detector 253. The vehicle traveling direction determination section 610 determines whether the input vehicle traveling direction is forward, or not, and outputs a Boolean value indicating the determination result to the excavation work prediction command section 630. In other words, the vehicle traveling direction determination section 610 outputs "TRUE" when the traveling direction of the vehicle is forward, and outputs "FALSE" when the traveling direction of the vehicle is other than forward (in the case of backward).

The working device to ground angle determination section 620 receives the working device to ground angle acquired by the working device to ground angle acquisition section 321. The working device to ground angle determination section 620 determines whether the input working device to ground angle falls within a predetermined range, or not, and outputs the Boolean value indicating the determination result to the excavation work prediction command section 630. In other words, the working device to ground angle determination section 620 outputs "TRUE" when the working device to ground angle falls within the predetermined range, and outputs "FALSE" when the working device to ground angle falls outside the predetermined range. In general, in order to make it easier to insert the bucket 151 into the excavation target at the time of starting excavation, the angle of the working device 150 to the ground is set substantially horizontal. For that reason, in the working machine to ground angle determination section 620, it is preferable that a range of the working device to ground angle described above is set corresponding to the angle to the ground at which the working device 150 is substantially horizontal. Further, the range may be a preset value, or may be set by the operator as an arbitrary value from an input device such as a button, a dial, or a touch panel.

The excavation work prediction command section 630 receives the Boolean value output from the vehicle traveling direction determination section 610 and the Boolean value output from the working device to ground angle determination section 620. The excavation work prediction command section 630 predicts whether the working device 150 will perform excavation, or not, based on those input Boolean values and outputs the excavation work prediction command to the excavation start determination section 310 according to the prediction result. In other words, when both of the two Boolean values are "TRUE", the wheel loader 100 is in the excavation start attitude, and the excavation work prediction command section 630 predicts that the working device 150 will perform excavation from now and outputs the excavation work prediction command. Whereas, when one or both of the two Boolean values are "FALSE", the wheel loader 100 is not in the excavation start attitude, and the excavation work prediction command section 630 predicts that the working device 150 will not perform excavation, and does not output the excavation work prediction command.

With the control configuration described above, the excavation work prediction section 320 can predict whether the working device 150 will perform excavation, or not, based on the working device to ground angle acquired by the working device to ground angle acquisition section 321 and the vehicle travel direction detected by the vehicle traveling direction detector 253.

[Excavation Start Determination Section 310]

Figure 4:
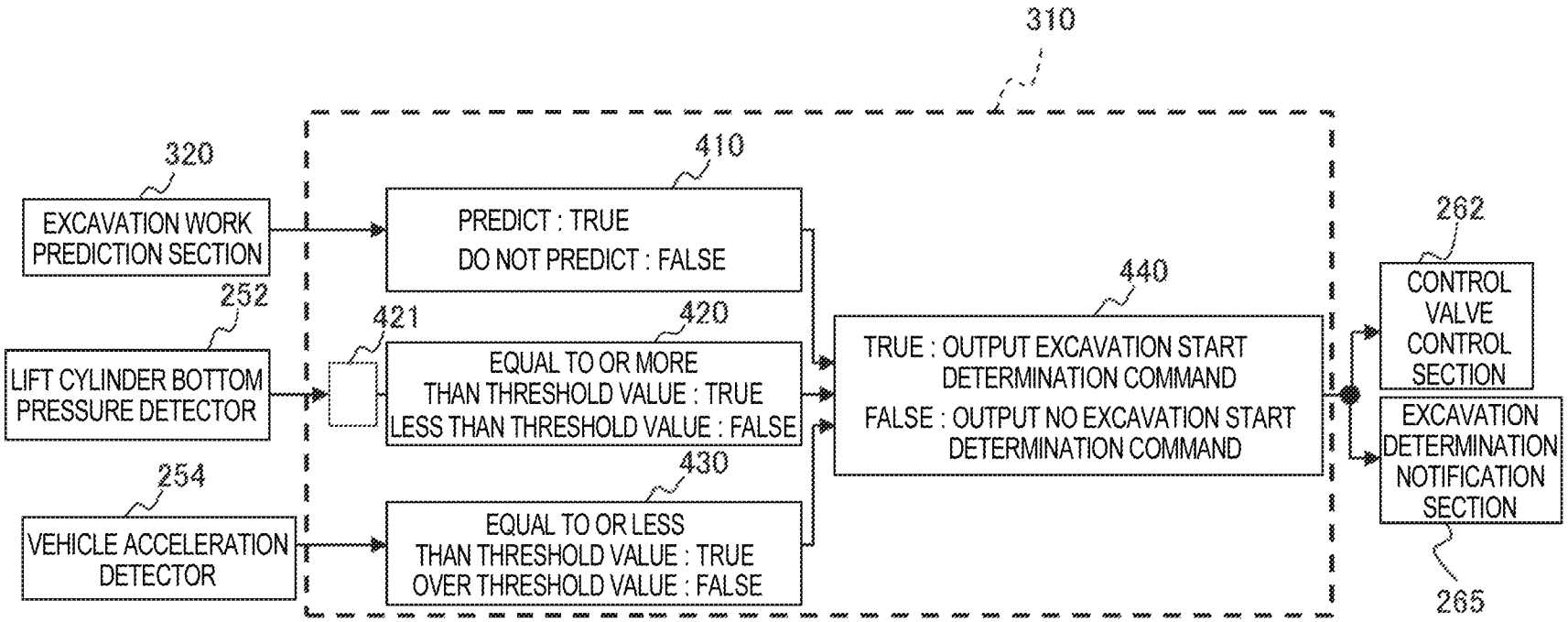
FIG. 4 is a control block diagram of an excavation start determination section.

Next, the details of the control process to be executed by the excavation start determination section 310 will be described. FIG. 4 is a control block diagram of the excavation start determination section 310. As shown in FIG. 4, the excavation start determination section 310 includes, as functions of the control process, an excavation work prediction determination section 410, a lift cylinder bottom pressure increasing speed determination section 420, a lift cylinder bottom pressure increasing speed calculation section 421, a vehicle acceleration determination section 430, and an excavation start determination command section 440.

The excavation work prediction determination section 410 receives the excavation work prediction command output from the excavation work prediction section 320. The excavation work prediction determination section 410 determines whether to have received the excavation work prediction command, or not, and outputs a Boolean value indicating the determination result to the excavation start determination command section 440. In other words, the excavation work prediction determination section 410 outputs "TRUE" when having received the excavation work prediction command, and outputs "FALSE" when having not received the excavation work prediction command.

The lift cylinder bottom pressure increasing speed calculation section 421 receives the lift cylinder bottom pressure detected by the lift cylinder bottom pressure detector 252. The lift cylinder bottom pressure increasing speed calculation section 421 obtains an increment of the input lift cylinder bottom pressure per unit time. In this example, since the increment of the lift cylinder bottom pressure per unit time (hydraulic actuator pressure) is synonymous with a speed at which the lift cylinder bottom pressure increases, in the following description, the increment of the lift cylinder bottom pressure per unit time will be referred to as "lift cylinder bottom pressure increasing speed". Then, the lift cylinder bottom pressure increasing speed calculation section 421 outputs the calculated lift cylinder bottom pressure increasing speed to the lift cylinder bottom pressure increasing speed determination section 420.

The lift cylinder bottom pressure increasing speed determination section 420 receives the lift cylinder bottom pressure increasing speed calculated by the lift cylinder bottom pressure increasing speed calculation section 421. The lift cylinder bottom pressure increasing speed determination section 420 determines whether the input lift cylinder bottom pressure increasing speed is equal to or more than a predetermined threshold value, or not, and outputs a Boolean value indicating the determination result to the excavation start determination command section 440. In other words, the lift cylinder bottom pressure increasing speed determination section 420 outputs "TRUE" when the lift cylinder bottom pressure increasing speed is equal to or more than the threshold value, and outputs "FALSE" when the lift cylinder bottom pressure increasing speed is less than the threshold value.

The vehicle acceleration determination section 430 receives the vehicle acceleration detected by the vehicle acceleration detector 254. The vehicle acceleration determination section 430 determines whether the input vehicle acceleration is equal to or less than a predetermined threshold value, or not, that is, whether the deceleration of the wheel loader 100 is equal to or more than a predetermined value, or not, and outputs a Boolean value indicating the determination result to the excavation start determination command section 440. In other words, the vehicle acceleration determination section 430 outputs "TRUE" when the vehicle acceleration is equal to or less than the threshold value (when the deceleration is equal to or more than the predetermined value), and outputs "FALSE" when the vehicle acceleration exceeds the threshold value (when the deceleration is less than the predetermined value).

The excavation start determination command section 440 receives a Boolean value output from the excavation work prediction determination section 410, a Boolean value output from the lift cylinder bottom pressure increasing speed determination section 420, and a Boolean value output from the vehicle acceleration determination section 430. The excavation start determination command section 440 performs the excavation start determination of the working device 150 based on those input Boolean values and outputs the excavation start determination command to the control valve control section 262 and the excavation determination notification section 265 according to the determination result. In other words, when all of three Boolean values are "TRUE", the excavation start determination command section 440 determines that the excavation has started and outputs the excavation start determination command. Whereas, when at least one of the three Boolean values is "FALSE", the excavation start determination command section 440 determines that the excavation has not started, and does not output the excavation start determination command.

Meanwhile, in the lift cylinder bottom pressure increasing speed determination section 420, it is preferable to set a different threshold value for the lift cylinder bottom pressure increasing acceleration according to the hardness of the excavation target. For example, when the excavation target is relatively soft, the increasing speed of the resistance force received from the excavation target when the bucket 151 is abutted against the excavation target is smaller than that when the excavation target is hard. For that reason, if the same threshold value as that when the excavation target is hard is used, a timing at which the Boolean value output from the lift cylinder bottom pressure increasing speed determination section 420 changes from "FALSE" to "TRUE" is delayed. As a result, the output of the excavation start determination command from the excavation start determination command section 440 is delayed, resulting in a possibility that the wheels 1 may slip. Therefore, it is preferable that the threshold value of the lift cylinder bottom pressure increasing speed is set to be larger as the excavation target is harder.

Also, it is preferable to set a different threshold value for the vehicle acceleration in the vehicle acceleration determination section 430 according to the hardness of the excavation target. However, it is preferable that the threshold value of the vehicle acceleration is set to be smaller as the excavation target is harder.

Figure 5:
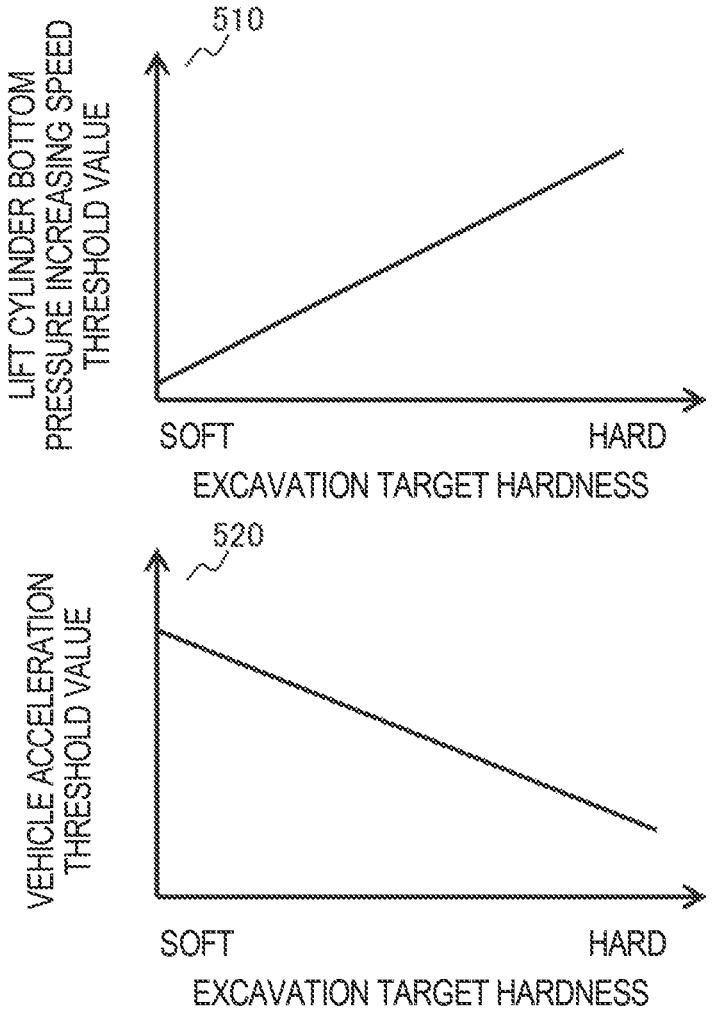
FIG. 5 is a diagram showing an example of changing a threshold value of a lift cylinder bottom pressure incremental acceleration and a threshold value of a vehicle acceleration according to a hardness of an excavation target.

FIG. 5 is a diagram showing an example of changing the threshold value of the lift cylinder bottom pressure increasing speed and the threshold value of the vehicle acceleration according to the hardness of the excavation target. In FIG. 5, a graph 510 shows an example of a relationship between the hardness of the excavation target and the threshold value of the lift cylinder bottom pressure increasing speed. In the example of the graph 510, the threshold value of the lift cylinder bottom pressure increasing speed is set so as to linearly increase as the excavation target becomes hard. The present invention is not limited to the example of the graph 510, if the threshold value of the lift cylinder bottom pressure increasing speed increases monotonically as the hardness of the excavation target increases, the threshold value of the lift cylinder bottom pressure increasing speed is available in the determination of the lift cylinder bottom pressure incremental acceleration determination section 420. This includes a monotonous increase in a broad sense, for example, such as a form including a section where the threshold value of the lift cylinder bottom pressure increasing speed is kept constant even if the hardness of the excavation target changes.

Meanwhile, in FIG. 5, a graph 520 shows an example of a relationship between the hardness of the excavation target and the threshold value of the vehicle acceleration. In the example of the graph 520, the threshold value of the vehicle acceleration is set so as to linearly decrease more as the excavation target becomes harder. It should be noted that the present invention is not limited to the example of the graph 520 and the threshold value of the vehicle acceleration is available in the determination of the vehicle acceleration determination section 430 as long as the threshold value of the vehicle acceleration decreases monotonically as the hardness of the excavation target increases. This includes a monotonic decrease in a broad sense, for example, such as a form including a section in which the threshold value of the vehicle acceleration is kept constant even if the hardness of the excavation target changes.

As described above, in the case where the threshold value of the lift cylinder bottom pressure increasing speed and the threshold value of the vehicle acceleration are changed according to a hardness of the excavation target, it is preferable that those threshold values are set taking a vehicle rank of the wheel loader 100 into consideration. For example, a table indicating a relationship between the hardness of the excavation target and the threshold value of the lift cylinder bottom pressure increasing speed and the threshold value of the vehicle acceleration according to the vehicle rank of the wheel loader 100 is stored in advance in the control device 240. When the hardness of the excavation target is set when the wheel loader 100 performs the excavation work, the control device 240 obtains the threshold value of the lift cylinder bottom pressure increasing speed and the threshold value of the vehicle acceleration corresponding to the set hardness of the excavation target from the table, and uses those threshold values thus obtained in the determinations of the cylinder bottom pressure increasing speed determination section 420 and the vehicle acceleration determination section 430. Incidentally, the hardness of the excavation target may be set to an arbitrary value by the operator through an input device such as a button, a dial, or a touch panel, or may be determined based on a previous excavation work.

In the present embodiment described above, as understood from a series of processes of the excavation start determination section 310, when the increasing speed of the lift cylinder bottom pressure exceeds the threshold value and the vehicle acceleration falls below the threshold value, the control device 240 determines that the bucket 151 has abutted against the excavation target and determines that the excavation has started. As described above, the determination is performed with the use of the increasing speed of the lift cylinder bottom pressure, thereby making it possible to determine that the excavation has started more rapidly than the determination when using the lift cylinder bottom pressure as it is. In the case where the determination is performed with the use of the lift cylinder bottom pressure as it is, as the threshold value for the lift cylinder bottom pressure is set smaller, an excavation reaction force can be detected more quickly and the excavation start determination can be performed. However, the possibility of the erroneous determination is increased as much. For example, when excavating clay-based earth and sand, earth and sand may remain without being dropped from the bucket 151 after being loaded on a dump truck. In that case, since a weight of the earth and sand remaining in the bucket 151 is added to the lift cylinder bottom pressure, although the bucket 151 is not abutted against the excavation target, the lift cylinder bottom pressure exceeds the threshold value and the erroneous determination may be performed. Therefore, in order to prevent the erroneous determination, there is a need to set the threshold value of the lift cylinder bottom pressure to a certain high level. For that reason, as compared with the present embodiment, the determination of the excavation start is delayed, which may cause the wheels 1 to slip.

Further, according to the present embodiment, in addition to the lift cylinder bottom pressure increasing speed, the determination of the excavation start is performed with the use of the vehicle acceleration. This makes it possible to avoid the erroneous determination caused by a variation in the lift cylinder bottom pressure increasing speed occurring when the lift arms 155 are greatly shaken due to the bound of the frame 110 or the like during traveling on a rough road, and to determine the excavation start more accurately.

Furthermore, according to the present embodiment, in addition to the above determination, the excavation work is predicted by the excavation work prediction section 320, and the excavation start determination is performed with the use of the prediction result. As a result, when traveling except for immediately before the excavation, for example, when performing a carrying work for transporting an excavated load or performing a "rise and run" function or the like for traveling forward while raising the working device 150 in order to load the excavation target onto the dump truck, or the like, the excavation start determination may not be performed. Therefore, the erroneous determination which can occur except for during the excavation work can be avoided and the excavation start can be determined more accurately.

[Actual Operation]

Figure 7:
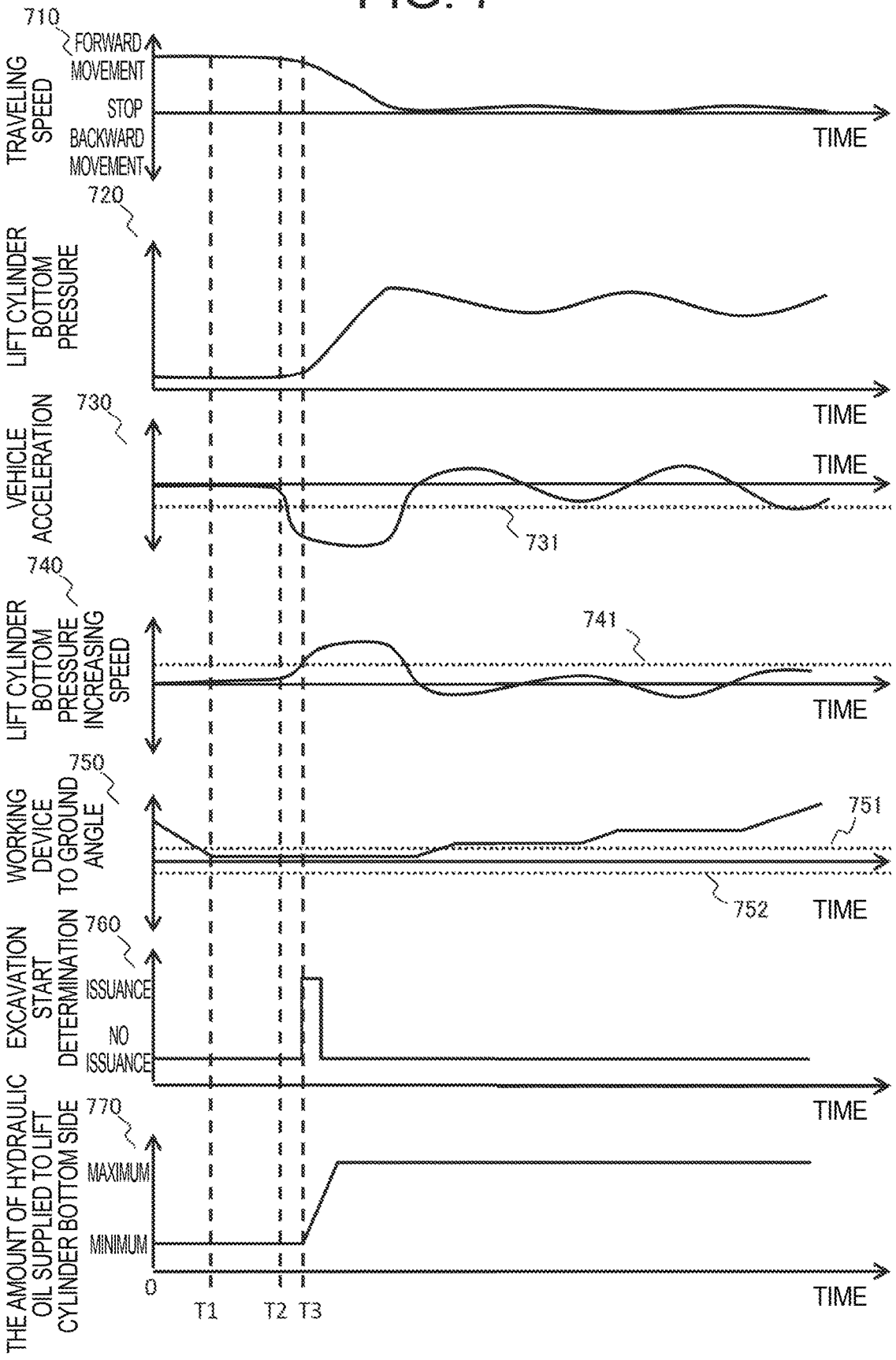
FIG. 7 is a diagram showing an example of the operation of a wheel loader according to the embodiment of the present invention.

FIG. 7 is a diagram showing an example of the operation of the wheel loader 100 according to the embodiment of the present invention configured as described above. In FIG. 7, a graph 710 shows the transition of the traveling speed, a graph 720 shows the transition of the lift cylinder bottom pressure, a graph 730 shows the transition of the vehicle acceleration, a graph 740 shows the transition of the lift cylinder bottom pressure increasing speed, a graph 750 shows the transition of the working device to ground angle, a graph 760 shows the transition of the excavation start determination command, and a graph 770 shows the transition of the hydraulic oil supply amount to the lift cylinder bottom side. A threshold value 731 in the graph 730 indicates the threshold value of the vehicle acceleration in the vehicle acceleration determination section 430 described above and a threshold value 741 in the graph 740 indicates the threshold value of the lift cylinder bottom pressure increasing speed in the lift cylinder bottom pressure increasing speed determination section 420 described above. In addition, an upper limit threshold value 751 and a lower limit threshold value 752 of the graph 750 indicate a range of the working device to ground angle in the working device to ground angle determination section 620 described above.

At a time 0, the wheel loader 100 is traveling in a state where the working device to ground angle is large, that is, in a state where the bucket opening faces upward, as shown by the graph 750. In a period from the above time 0 to a time T1, since the process is transitioned to the excavation work, the wheel loader 100 advances toward the excavation target as shown in the graph 710 while the working device to ground angle is adjusted to be smaller as shown in the graph 750.

At the time T1, when the vehicle traveling direction is forward as shown in the graph 710 and the working device to ground angle falls within a range between the upper limit threshold value 751 and the lower limit threshold value 752 as shown in the graph 750, the excavation work prediction section 320 outputs the excavation work prediction command to the excavation start determination section 310. Thereafter, when the leading end of the working device 150 abuts against the excavation target at a time T2, the lift cylinder bottom pressure increasing speed starts to increase as shown in the graph 720, and the vehicle acceleration starts to decrease as shown in the graph 730.

At a time T3, as described above, when the excavation work prediction command by the excavation work prediction section 320 is input, and the lift cylinder bottom pressure increasing speed exceeds the threshold value 741 as shown in the graph 740 and the vehicle acceleration falls below the threshold value 731 as shown in the graph 730, the excavation start determination section 310 determines that the excavation is to be started and outputs the excavation start determination command to the control valve control section 262 and excavation determination notification section 265. When the excavation start determination command is output as described above, the control valve control section 262 controls the control valve 221 so as to start supplying the hydraulic oil to the bottom side of the lift cylinder 152, or the excavation determination notification section 265 notifies the operator of the excavation start, and the operator performs the lifting operation of the working device 150 according to the notification of the excavation start. As a result, the lift arms 155 are lifted.

As described above, the control device 240 according to the present embodiment determines the excavation start based on the increasing speed of the hydraulic actuator pressure, that is, the lift cylinder bottom pressure increasing speed. As a result, the excavation start can be determined without any delay as compared with the case where the hydraulic actuator pressure is used as it is. Further, when the vehicle acceleration exceeds a predetermined threshold value or when it is predicted that the working device 150 will not perform the excavation, it is not determined that the excavation is started. As a result, the erroneous determination can be avoided and the timing of the excavation start can be determined more accurately. Therefore, the lifting operation of the working device 150 can be performed at an appropriate timing.

[Power Transmission Device 210]

Finally, a specific example of the power transmission device 210 will be described below with reference to FIGS. 9 to 12.

Figure 9:
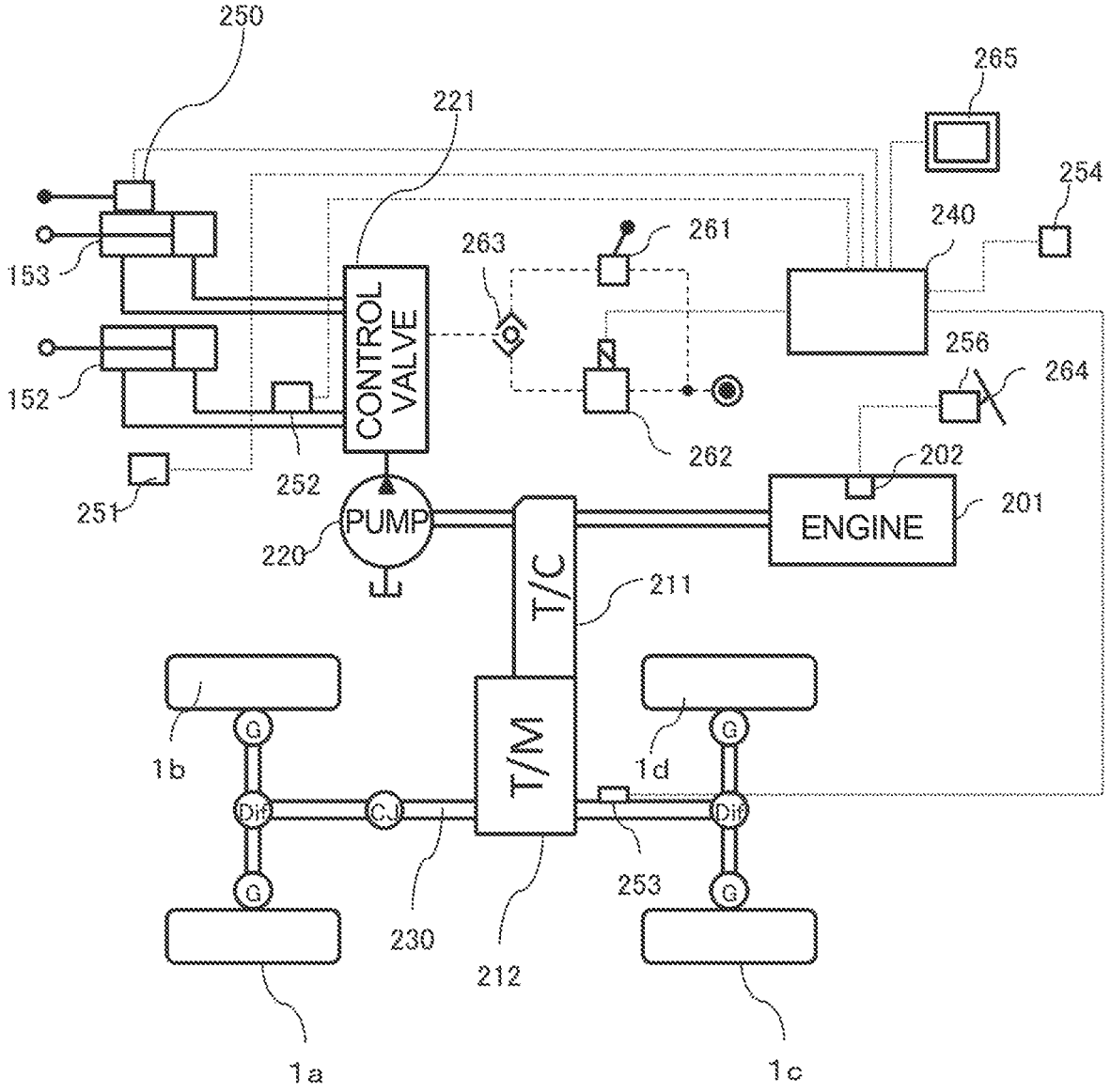
FIG. 9 is a diagram showing an example of a system configuration of the wheel loader when a torque converter power transmission mechanism is employed.

FIG. 9 is an example of a system configuration diagram of the wheel loader 100 in the case where a torque converter power transmission mechanism that converts a power of the engine 201 into a flow of hydraulic oil and transmits the flow of hydraulic oil to the wheels 1 is adopted as the power transmission device 210. In the example shown in FIG. 9, the wheel loader 100 includes a torque converter 211 that is connected to an output shaft of the engine 201, and a stepped transmission 212 that changes the power output from the torque converter 211 by a gear mechanism. The stepped transmission 212 rotationally drives the respective wheels 1 through the propeller shaft 230.

Figure 10:
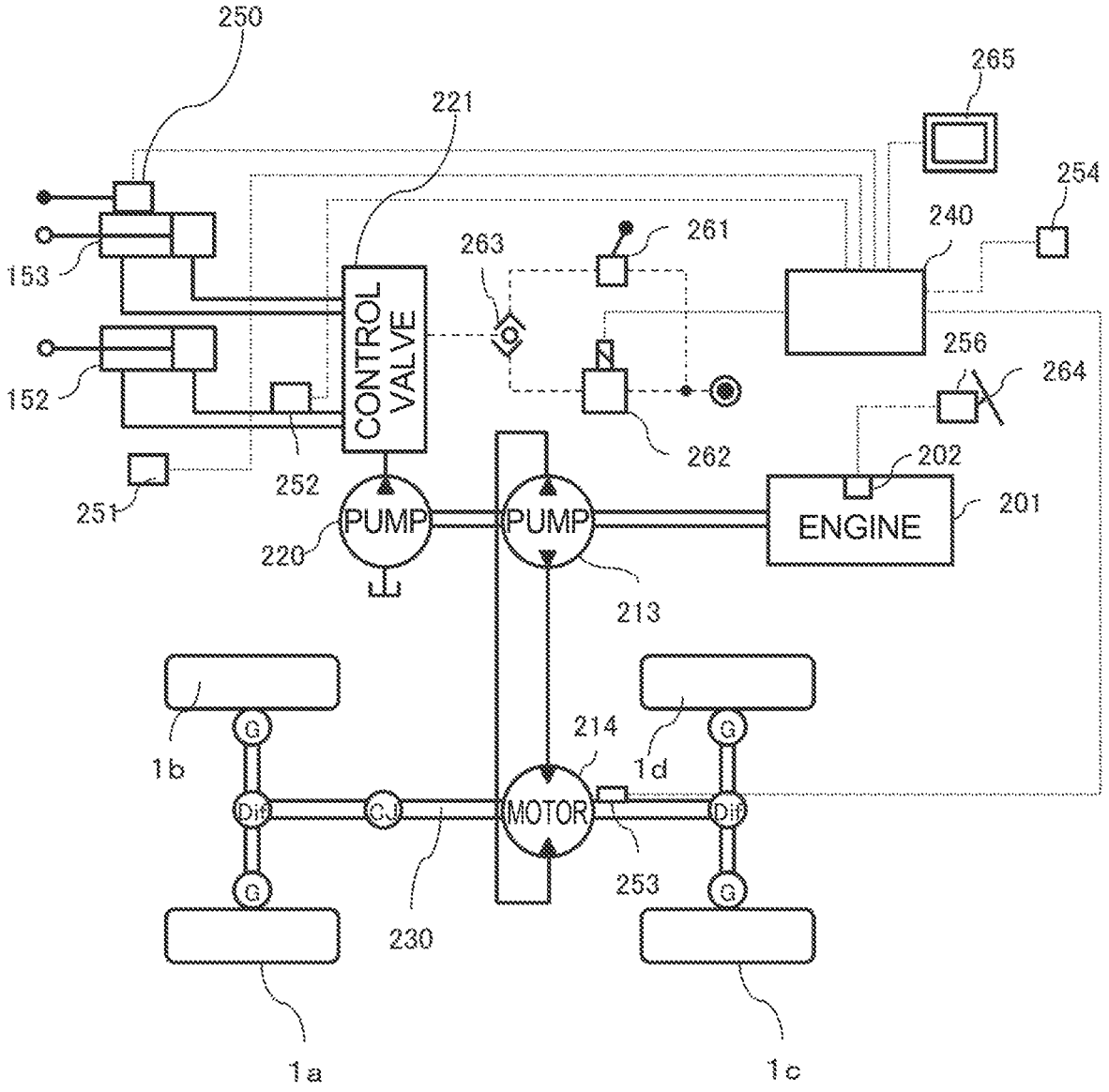
FIG. 10 is a diagram showing an example of a system configuration of the wheel loader employing an HST power transmission mechanism.

FIG. 10 is an example of a system configuration diagram of the wheel loader 100 employing an HST power transmission mechanism that converts the power of the engine 201 into a hydraulic pressure and transmits the hydraulic pressure to the wheels 1 as the power transmission device 210. In the example shown in FIG. 10, the wheel loader 100 includes a hydraulic pump 213 that is connected to the output shaft of the engine 201 and a hydraulic motor 214 that is rotationally driven by the hydraulic oil discharged from the hydraulic pump 213. The hydraulic motor 214 rotationally drives the respective wheels 1 through the propeller shaft 230.

Figure 11:
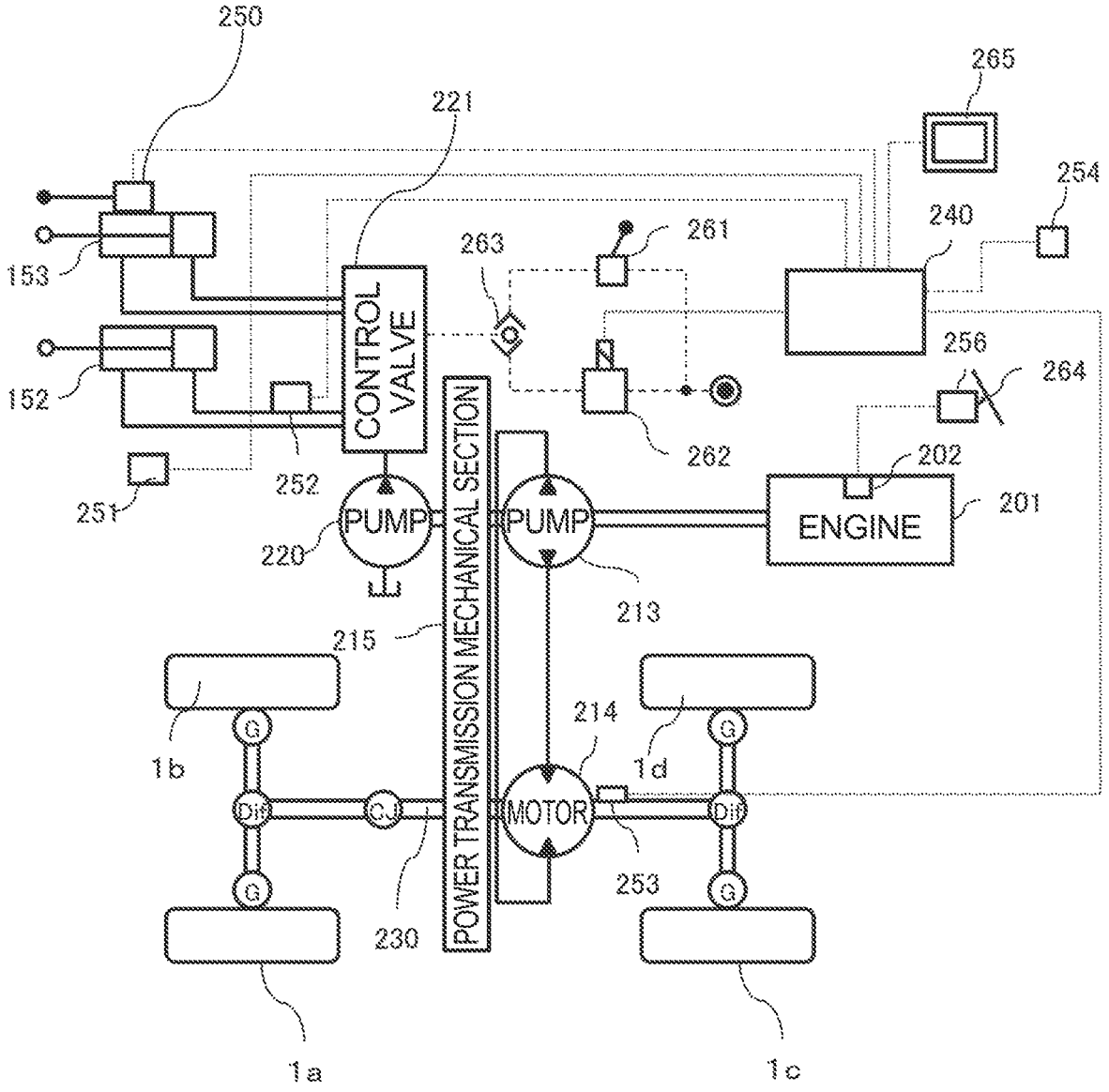
FIG. 11 is a diagram showing an example of a system configuration of the wheel loader employing an HMT power transmission mechanism.

FIG. 11 is an example of a system configuration diagram of the wheel loader 100 that employs an HMT power transmission mechanism as the power transmission device 210. In the example shown in FIG. 11, the wheel loader 100 further includes a power transmission mechanical section 215 in addition to the hydraulic pump 213 and the hydraulic motor 214. In this example, the hydraulic pump 213 drives the propeller shaft 230 through the hydraulic motor 214 to drive the wheels 1 while the engine 201 drives the propeller shaft 230 through the power transmission mechanical section 215 to drive the wheels 1. The power transmission mechanical section 215 is a mechanical mechanism for mechanically connecting the output shaft of the engine 201 and the propeller shaft 230, and is configured by using, for example, a swash plate piston, a planetary gear, or the like.

Figure 12:
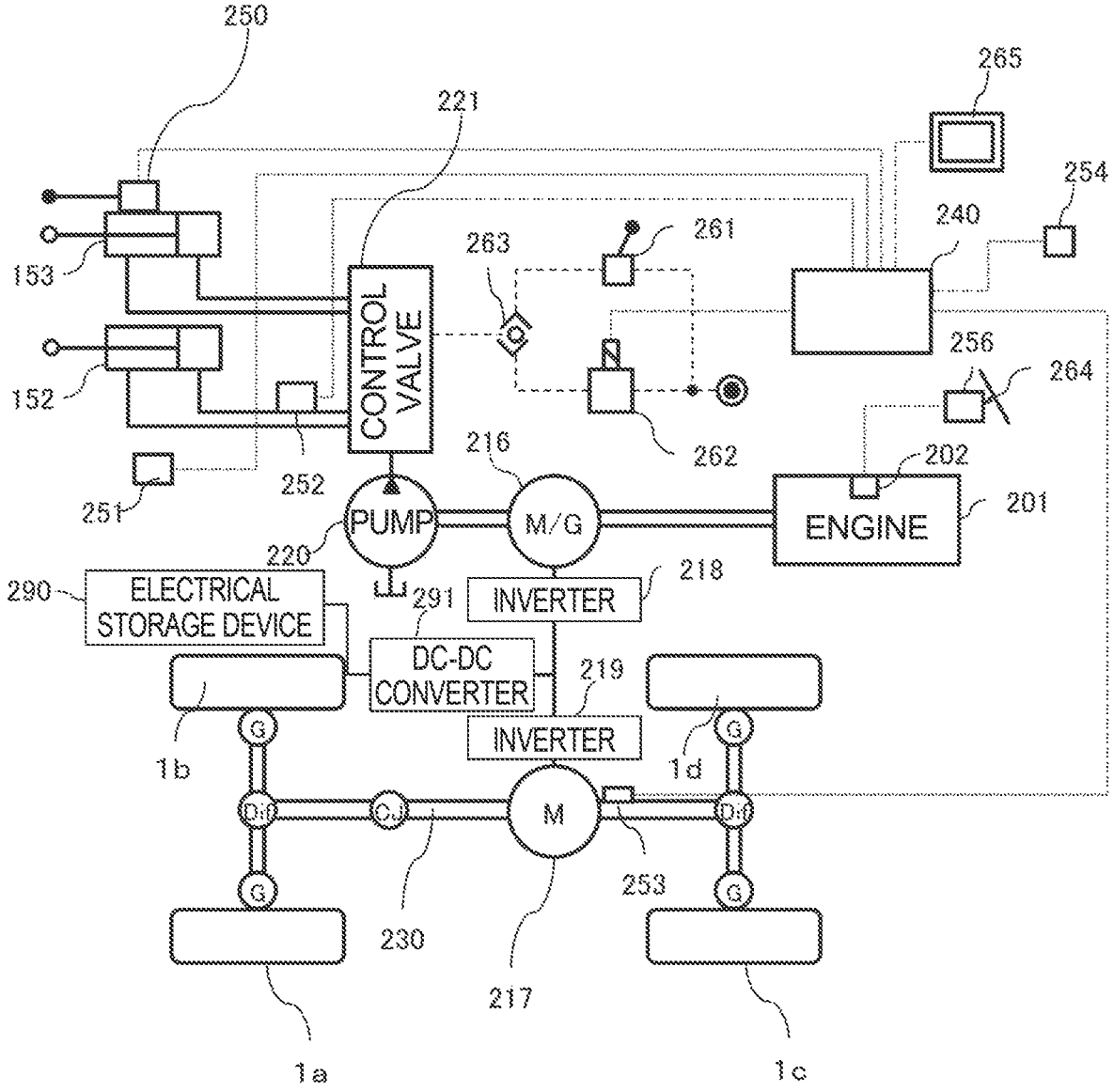
FIG. 12 is a diagram showing an example of a system configuration of the wheel loader employing a hybrid power transmission mechanism.

FIG. 12 is an example of a system configuration diagram of the wheel loader 100 that adopts a hybrid power transmission mechanism that converts the power of the engine 201 into electricity and transmits the electricity to the wheels 1 as the power transmission device 210. In the example of FIG. 12, the wheel loader 100 includes a motor generator (motor/generator) 216 that is mechanically connected to the engine 201 and driven by the engine 201, an inverter 218 that controls the motor generator 216, a traveling motor 217 that drives the four wheels 1 attached to the propeller shaft 230 through a differential gear Dif and a gear G, an inverter 219 that controls the traveling motor 217, and an electrical storage device 290 that is electrically connected to the inverters 218 and 219 through a DC-DC converter 291. The electrical storage device 290 is configured by, for example, a secondary battery or a capacitor, and exchanges a DC power between the inverter 218 and the inverter 219. In the system configuration diagram of FIG. 12, a configuration example of a so-called series hybrid system is shown, but a parallel hybrid system is also available.

According to the embodiment of the present invention described above, the following operational effects are obtained.

(1) The wheel loader 100 which is a work vehicle includes the working device 150, the lift cylinder 152 which is a hydraulic actuator for driving the working device 150, the hydraulic pump 220 which supplies hydraulic oil to the lift cylinder 152, the hydraulic actuator pressure detector that detects the pressure of the lift cylinder 152, that is, the lift cylinder bottom pressure detector 252 that detects the lift cylinder bottom pressure, the control valve 221 that controls the amount of hydraulic oil to be supplied from the hydraulic pump 220 to the lift cylinder 152, the vehicle acceleration detector 254 that detects the vehicle acceleration in the longitudinal direction, and the control device 240. The control device 240 determines whether the working device 150 has started excavation, or not, based on the lift cylinder bottom pressure detected by the lift cylinder bottom pressure detector 252 and the vehicle acceleration detected by the vehicle acceleration detector 254. With the above configuration, the excavation start timing can be determined quickly and accurately.

(2) The control device 240 includes the excavation start determination section 310. The excavation start determination section 310 calculates the hydraulic actuator pressure increasing speed, that is, the lift cylinder bottom pressure increasing speed according to the lift cylinder bottom pressure by the lift cylinder bottom pressure increasing speed calculation section 421. When the lift cylinder bottom pressure increasing speed determination section 420 determines that the lift cylinder bottom pressure increasing speed is equal to or more than a predetermined threshold value and the vehicle acceleration determination section 430 determines that the vehicle acceleration is equal to or less than a predetermined threshold value, the excavation start determination command section 440 determines that the working device 150 has started the excavation. With the above configuration, the excavation start can be determined quickly while the erroneous determination caused by an unexpected variation in the lift cylinder bottom pressure increasing speed or the like is avoided.

(3) The wheel loader 100 further includes the vehicle traveling direction detector 253 that detects whether the vehicle traveling direction is forward or backward. The control device 240 includes the working device to ground angle acquisition section 321 that acquires an angle of the working device 150 to the ground, and the excavation work prediction section 320 that predicts that the working device 150 will perform the excavation when the vehicle traveling direction is forward and the angle of the working device 150 to the ground falls within a predetermined range. When the excavation work prediction section 320 predicts that the working device 150 will perform the excavation, the excavation start determination section 310 determines whether the working device 150 has started the excavation, or not, based on the lift cylinder bottom pressure and the vehicle acceleration. With the above configuration, the erroneous determination that can occur except for the excavation work can be avoided and the excavation start can be determined more accurately.

(4) The wheel loader 100 further includes the excavation determination notification section 265 that gives a notification to the effect that the operator is urged to lift the working device 150 when it is determined by the control device 240 that the working device 150 has started the excavation. With the above configuration, the operator can be caused to lift the working device 150 without any delay at the time of starting the excavation.

(5) In addition, the wheel loader 100 further includes the control valve control section 262 that controls the control valve 221 and starts the supply of hydraulic oil from the hydraulic pump 220 to the lift cylinder 152 when the control device 240 determines that the working device 150 has started the excavation. With the above configuration, the lifting operation of the working device 150 can be carried out without any delay at the time of starting the excavation.

In the embodiment described above, the example in which the wheel loader 100 includes both of the control valve control section 262 and the excavation determination notification section 265 has been described. Alternatively, only one of those sections may be provided. Furthermore, without the provision of both of the control valve control section 262 and the excavation determination notification section 265, the excavation start determination command output from the control device 240 may be output to the outside through an output terminal or the like provided in the wheel loader 100.

In the embodiment described above, as shown in FIG. 3, the control device 240 includes the working device to ground angle acquisition section 321, the excavation work prediction section 320, and the excavation start determination section 310. However, there is no need to provide the working device to ground angle acquisition section 321 and the excavation work prediction section 320. In that case, the excavation start determination section 310 does not need to include the excavation work prediction determination section 410, and the excavation start determination command section 440 may perform the excavation start determination based on the Boolean value output from the lift cylinder bottom pressure increasing speed determination section 420 and the Boolean value output from the vehicle acceleration determination section 430. In other words, when both of those two Boolean values are "TRUE", the vehicle acceleration determination section 430 determines that the excavation is to be started and outputs the excavation start determination command. Whereas, when either one or both of the two Boolean values are "FALSE", the vehicle acceleration determination section 430 determines that the excavation is not to be started, and does not output the excavation start determination command. Alternatively, this process may be carried out.

The present invention is not limited to the embodiments described above, but includes various modifications without departing from the spirit of the present invention. For example, the present invention is not limited to the provision of all the configurations described in the above embodiments but includes the deletion of a part of the configurations. Also, a part of the configuration of one embodiment can be added or replaced with the configuration of another embodiment. In addition, other modes conceivable to fall within a technical concept of the present invention also fall within the scope of the present invention.

REFERENCE SIGNS LIST

100 . . . wheel loader
110 . . . frame

150 . . . working device
151 . . . bucket
152 . . . lift cylinder
153 . . . bucket cylinder
154 . . . bell crank
155 . . . lift arm
201 . . . engine
202 . . . electrically controlled governor
210 . . . power transmission device
220 . . . hydraulic pump
221 . . . control valve
230 . . . propeller shaft
240 . . . control device
250 . . . bucket cylinder stroke detector
251 . . . lift arm angle detector
252 . . . lift cylinder bottom pressure detector
253 . . . vehicle traveling direction detector
254 . . . vehicle acceleration detector
256 . . . accelerator manipulated variable detector
261 . . . working device control lever
262 . . . control valve control section
263 . . . high pressure selection valve
264 . . . accelerator pedal
265 . . . excavation determination notification section
310 . . . excavation start determination section
320 . . . excavation work prediction section
321 . . . working device to ground angle acquisition section
410 . . . excavation work prediction determination section
420 . . . lift cylinder bottom pressure increasing speed determination section
421 . . . lift cylinder bottom pressure increasing speed calculation section
430 . . . vehicle acceleration determination section
440 . . . excavation start determination command section
610 . . . vehicle traveling direction determination section
620 . . . working device to ground angle determination section
630 . . . excavation work prediction command section

The invention claimed is:

1. A wheel loader comprising:

a frame;

a lift arm attached to a front of the frame;

a bucket attached to a distal end of the lift arm;

a hydraulic actuator that rotates the lift arm in a vertical direction;

a hydraulic pump that supplies hydraulic oil to the hydraulic actuator;

a hydraulic actuator pressure detector that detects a pressure of the hydraulic actuator;

a control valve that controls the amount of hydraulic oil to be supplied from the hydraulic pump to the hydraulic actuator;

a vehicle acceleration detector that detects a vehicle acceleration of the wheel loader; and a control device that determines whether excavation by the bucket has been started, or not, based on an increasing speed of the pressure of the hydraulic actuator detected by the hydraulic actuator pressure detector and the vehicle acceleration detected by the vehicle acceleration detector, wherein the control device includes an excavation start determination section that calculates an increment of the pressure of the hydraulic actuator per unit time, as the increasing speed of the pressure of the hydraulic actuator, according to the pressure of the hydraulic actuator detected by and input from the hydraulic actuator pressure detector and determines that excavation by the bucket has been started in a case where the increment is equal to or more than a predetermined first threshold value and the vehicle acceleration is equal to or less than a predetermined second threshold value.

2. The wheel loader according to claim 1, further comprising:

a bucket cylinder stroke detector that detects a stroke of the bucket cylinder, a lift arm angle detector that detects an angle of the lift arm, and a vehicle traveling direction detector that detects whether a vehicle traveling direction is forward or backward, wherein the control device includes a working device to ground angle acquisition section that acquires an angle of the bucket to the ground based on the stroke of the bucket cylinder detected by the bucket cylinder stroke detector and the angle of the lift arm detected by the lift arm angle detector and an excavation work prediction section that predicts that excavation by the bucket is performed in a case where the vehicle traveling direction detected by the vehicle traveling direction detector is forward and the angle of the bucket to the ground acquired by the working device to ground angle acquisition section falls within a predetermined range, and the excavation start determination section determines whether excavation by the bucket has been started, or not, based on the increasing speed of the pressure of the hydraulic actuator and the vehicle acceleration in a case where the excavation work prediction section predicts that excavation by the bucket is performed.

3. The wheel loader according to claim 1, wherein the control device further includes an excavation determination notification section that gives notification to the effect that an operator is urged to lift the bucket in a case where it is determined that excavation by the bucket has been started.

4. The wheel loader according to claim 1, wherein the control device further includes a control valve control section that controls the control valve to start supply of hydraulic oil from the hydraulic pump to the hydraulic actuator in a case where it is determined that excavation by the bucket has been started.

* * * * *